US006057265A

United States Patent [19]

Imai

[11] Patent Number: 6,057,265

[45] Date of Patent: May 2, 2000

[54] MEDIUM, INK SHEET AND IMAGE-RECEIVING SHEET FOR THERMAL TRANSFER PRINTING

[75] Inventor: Akihiro Imai, Ikoma, Japan

[73] Assignee: Matsushita Electric Industrial Co., Ltd., Osaka, Japan

[21] Appl. No.: 08/991,271

[22] Filed: Dec. 16, 1997

[30] Foreign Application Priority Data

Dec. 18, 1996 [JP] Japan ..... 8-337886
Nov. 5, 1997 [JP] Japan ..... 9-302661

[51] Int. Cl.[7] ..... B41M 5/035; B41M 5/38

[52] U.S. Cl. ..... 503/227; 428/195; 428/421; 428/913; 428/914

[58] Field of Search ..... 8/471; 428/195, 428/447, 913, 914, 421, 422; 503/227

[56] References Cited

U.S. PATENT DOCUMENTS 5,234,889 8/1993 De Palma et al. ..... 503/227
5,763,358 6/1998 Kaszczuk et al. ..... 503/227

FOREIGN PATENT DOCUMENTS 61-143195 6/1986 Japan ..... 503/227
61-237694 10/1986 Japan ..... 503/227
61-244589 10/1986 Japan ..... 503/227
62-82086 4/1987 Japan ..... 503/227
1-176588 7/1989 Japan ..... 503/227
1-214475 8/1989 Japan ..... 503/227
5-131770 5/1993 Japan ..... 503/227
5-208564 8/1993 Japan ..... 503/227
7-164768 6/1995 Japan ..... 503/227

*Primary Examiner*—Bruce H. Hess
*Attorney, Agent, or Firm*—Ratner & Prestia

[57] ABSTRACT

The invention provides ink sheets for thermal transfer recording including a heat resistant lubricating layer, having sufficient lubricating characteristic on the surface of heat resistant lubricating layer, excellent in running stability in recording, and showing favorable storage characteristic hardly lowered in the lubricating characteristic after storage in the condition of high temperature and high humidity, and also ink sheets and image-receiving sheets for sublimation type thermal transfer recording, excellent in thermal fusion preventing characteristic between the ink sheet and image-receiving sheet, showing favorable storage characteristic less contaminated by dye by re-transfer of dye after storage in the condition of high temperature and high humidity, reusable in paint, and hence economical.

49 Claims, 1 Drawing Sheet

MEDIUM, INK SHEET AND IMAGE-RECEIVING SHEET FOR THERMAL TRANSFER PRINTING

FIELD OF THE INVENTION

The present invention relates to ink sheet and image-receiving sheet used in thermal transfer printing using recording medium such as thermal head, laser and other optical head, energizing head, etc. The ink sheet relates to an ink sheet for sublimation type thermal transfer recording and/or an ink sheet for molten type thermal transfer recording, and the image-receiving sheet relates to an image-receiving sheet for sublimation type thermal transfer recording.

BACKGROUND OF THE INVENTION

In sublimation type or molten type thermal transfer recording, a film of polyethylene terephthalate (PET) is generally used as the base material for the ink sheet, but since the heat resistance and running lubricity of the PET film are insufficient when used in the recording head such as thermal head, a heat resistant lubricating layer having heat resistance and lubricity is usually formed and used at the base material side of the ink sheet in contact with the recording head.

As such heat resistant lubricating layer, it has been widely proposed to use substances having polysiloxane as constituent component, for example, a vinyl polymer by block or graft coupling of organopolysiloxane units as disclosed in Japanese Laid-open Patent No. 61-143195, silicone denatured urethane resin as disclosed in Japanese Laid-open Patent No. 62-82086, stick-preventive layer made of silicone graft polymer as disclosed in Japanese Laid-open Patent No. 1-214475, and a heat resistant protective layer of amino denatured polysiloxane and polyisocyanate or reaction product of both as disclosed in Japanese Laid-open Patent No. 5-131770.

The component for providing the heat resistant lubricating layer with lubricity is, for example, a silicone graft polymer is a polymer having silicone grafted in a polymer, and therefore it is low in the content of free silicone such as liquid silicone and the silicone content is not so much although some have film forming capability, and a sufficient lubricating performance is not obtained.

Hitherto proposed liquid silicone oils such as amino denatured polysiloxane are superior to silicone graft polymer in lubricity, but not sufficient, and to obtain a required lubricity, it is necessary to increase the adding amount relatively, and moreover since the molecular weight is not so large, when the ink sheet is stored in the condition of high temperature and high humidity in rolled state, silicone oil is likely to diffuse and move from the heat resistant lubricating layer side into the color material layer side which rolls and contacts with the heat resistant lubricating layer, and, as a result, the lubricity of the heat resistant lubricating layer is lowered after storage, and creases are likely to be formed when recording.

In sublimation type thermal transfer recording, usually, the ink sheet and image-receiving sheet are joined together between the recording head and platen, the back side of the ink sheet is heated by the recording head heated according to the recording signal, and the dye in the color material layer of the ink sheet is transferred in the dye image-receiving layer of the image-receiving sheet by sublimation or diffuse transfer process, thereby forming a recording image in the image-receiving sheet. In this recording process, the color material layer of the ink sheet and the dye image-receiving layer of the image-receiving sheet receive a larger thermal energy from the recording head in the face-to-face contact state, and the heat resistance of the high polymer used in the color material layer and dye image-receiving layer cannot be set too high for the ease of migration of the dye in the color material layer into the dye image-receiving layer, and therefore thermal fusion is likely to occur on the contact surfaces of both layers. To prevent thermal fusion, generally, various parting agents are applied on both layers.

Incidentally, when recording by a printer, feed of plural image-receiving sheets is likely to occur in the automatic sheet feeder in which multiple image-receiving sheets are set, and to solve this problem, the back side of the image-receiving sheets is coated with various lubricants to improve running performance of the image-receiving sheets.

Proposals about the ink sheet include, for example, the parting polymer contained in the color material layer of the ink sheet as disclosed in Japanese Laid-open Patent No. 7-164768, proposals about the image-receiving sheet include, for example, the use of polyoxy alkylene silicone copolymer in the dye image-receiving layer of the image-receiving sheet as disclosed in Japanese Laid-open Patent No. 61-244589, the use of reaction curing type silicone oil as disclosed in Japanese Laid-open Patent No. 61-237694, and the use of silicone particles as disclosed in Japanese Laid-open Patent No. 1-176588.

Among the hitherto proposed polyoxy alkylene silicone copolymers, in particular, the non-reaction type parting agent is excellent in prevention of thermal fusion, but involves a new problem. That is, the ink sheet is fabricated, and it is turned in the process until finally wound in the cassette, and is also turned when slitting, and thus several turning operations are done. In the turning operations, when a non-reaction parting agent is used in the color material layer of the ink sheet, since the conventional parting agent is not so large in molecular weight, the parting agent in the color material layer of the ink sheet is likely to be transferred on the back side of the ink sheet, and hence the dye is also likely to be transferred in the parting agent transferred on the back side. Or, since the dye is dissolved in the parting agent, as the parting agent is transferred, the dye is also transferred. As a result, after finally winding in the cassette, when the ink sheet is rolled and stored in the condition of high temperature and high humidity, the dye transferred on the back side of the ink sheet is further transferred again on other color material layer of the surface, which causes a problem of contamination of other color material layer with dye. On the other hand, in the case of reaction curing type silicone oil, it is excellent in thermal fusion preventive characteristic, and the content of free silicone oil of low molecular weight is small, and hence the problem of contamination with dye is rare, but the paint containing expensive dye used in forming of color material layer is of reaction curing type, and is hard to be recycled. Silicone particles are effective against contamination with dye, but are not sufficient in thermal fusion preventive characteristics.

Similarly, when added to the dye image-receiving layer of the image-receiving sheet, the conventional polyoxy alkylene silicone copolymers, mainly non-reaction type parting agents, are not so large in molecular weight, and the parting agents are hence likely to be released from the dye image-receiving layer forming resin. When the image-receiving sheet having recording image is stored at high temperature and high humidity, part of the recording image dye is released together with the parting agent, and if touched by hand after storage, part of the recorded dye is transferred again on the hand, and thus the fixing of the dye may be lowered. The reaction curing type silicone oil is rare in the problem in storage at high temperature and high humidity, but same as the color material layer, it is hard to recycle the dye image-receiving layer forming paint. When silicone particles are used in the dye image-receiving layer, too, the thermal fusion preventive performance is not excellent.

When a plurality of image-receiving sheets having recording images are joined together and stored in the condition of high temperature and high humidity, the dye of the recording image is similarly transferred again on the resin layer on the back side of the image-receiving sheet having the dye image-receiving layer formed on the surface, and the back side of the image-receiving sheet may be contaminated.

SUMMARY OF THE INVENTION

It is hence an object of the invention to provide an ink sheet for thermal transfer recording forming a heat resistant lubricating layer, having a sufficient lubricating characteristic on the surface of the heat resistant lubricating layer, excellent in running stability in recording, and exhibiting an excellent storage characteristic, hardly lowered in the lubricating characteristic, after storage in the condition of high temperature and high humidity. It is also an object to provide an ink sheet for sublimation type thermal transfer recording and an image-receiving sheet, excellent in thermal fusion preventive characteristic of the ink sheet and image-receiving sheet, presenting an excellent storage characteristic, less in contamination with dye such as retransfer of dye, after storage in the condition of high temperature and high humidity, and economical because the dye can be recycled.

The ink sheet of the invention is an ink sheet for thermal transfer recording having a color material layer formed on one side of a base material, and having a heat resistant lubricating layer containing a polysiloxane-polyoxy alkylene block copolymer having specific constituent units formed on other side of the base material, or an ink sheet for sublimation type thermal transfer recording having a coloring material layer composed of a dye, a binder, and a polysiloxane-polyoxy alkylene block copolymer having specific constituent units formed on one side of a base material.

The image-receiving sheet of the invention is an image-receiving sheet for sublimation type thermal transfer recording having a dye image-receiving layer composed of a resin having dye affinity and a polysiloxane-polyoxy alkylene block copolymer having specific constituent units formed on one side of a base material, or an image-receiving sheet for sublimation type thermal transfer recording having a dye image-receiving layer formed on one side of a substrate, and a resin layer composed of a high polymer substance and a polysiloxane-polyoxy alkylene block copolymer having specific constituent units formed on other side of the base material.

The medium for thermal transfer recording of the invention comprises a base material sheet having a first surface and a second surface, and a color function layer placed on the first surface, in which the color function layer contains (a) a medium element for sublimation type thermal transfer recording, and (b) a block copolymer of polysiloxane and polyoxy alkylene.

DETAILED DESCRIPTION OF THE INVENTION

Figure 1:
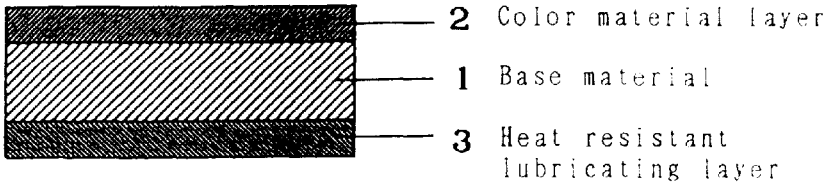
FIG. 1 is a schematic sectional view of an ink sheet for thermal transfer recording according to an embodiment of the invention.

FIG. 1 is a schematic sectional view of an ink sheet for thermal transfer recording according (hereinafter called ink sheet) of the invention as an embodiment.

The ink sheet has at least a color material layer 2 formed on one side of a base material 1, and has at least a heat resistant lubricating layer 3 formed on other side.

The base material 1 is not particularly limited, but, for example, various high molecular films, or high molecular films having the surface treated by coating or the like, or various conductive films are used. Examples of various high molecular films include films of polyolefin series, polyamide series, polyester series, polyimide series, polyether series, cellulose series, polyparabanic acid series, polyoxy diazole series, polystyrene series, and fluorine series. In particular, films of polyethylene terephthalate, polyethylene naphthalate, Aramide, triacetyl cellulose, polyparabanic acid, polysulfone, polypropylene, cellophane, moisture-proof treated cellophane, and polyethylene are useful. Moreover, in order that the color material layer may not be peeled from the film when recording, on the surface of the high molecular film or conductive film contacting with the sublimation type color material layer containing sublimate (or diffuse) dye, a high molecular film or conductive film having an adhesive layer (anchor coat layer) should be preferably used as base material. As various conductive films include, for example, high molecular films containing various conductive particles such as carbon black and metal powder, and high molecular films having conductive evaporation layer are useful.

The color material layer 2 is composed of at least color material and binder. The color material is pigment or dye, and is not particularly defined, and color materials proposed as the color material layer for thermal fusion type ink sheet or sublimation type ink sheet may be used. Pigments may include inorganic pigments and organic pigments, and examples include white pigments such as zinc white, titanium oxide, zinc sulfide and barium sulfate, black pigments such as carbon black and graphite, and various colored pigments such as phthalocyanine series, quinacridone series, azo series, and thioindigo series. Examples of dyes include disperse dye, acidic dye, basic dye, and oil soluble dye.

The binder of the color material layer 2 is not particularly defined, too, and examples include saturated polyester and other polyester resin, polyvinyl chloride, chlorinated vinyl chloride polymer, vinyl chloride-vinyl acetate copolymer, vinyl chloride-ester acrylate copolymer and other vinyl chloride resin, polymethyl methacrylate, acrylonitrilestyrene copolymer and other acrylic resin, polyvinyl formal, polyvinyl butyral and other polyvinyl acetal resin, methyl cellulose, ethyl cellulose, hydroxy ethyl cellulose, and other cellulose resin. These resins may be cured by using crosslinking agent or hardener, and used as binder.

The heat resistant lubricating layer 3 comprises at least a binder and a polysiloxane-polyoxy alkylene block copolymer. The polysiloxane-polyoxy alkylene block copolymer has constituent units as shown in formula (A) below.

(A)

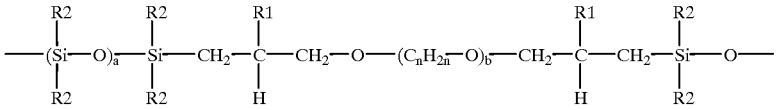

In formula (A), a and b are integers of 2 or more, R1 is hydrogen atom or monovalent hydrocarbon group, R2 is a monovalent hydrocarbon group, and R1 and R2 may be either same or different, n is an integer of 2 to 4, and ($_nH_{2n}$—O) b unit may have two or more ($C_nH_{2n}$—O) b units differing in the value of n, and at this time the value of b may be same or different.

As the polysiloxane-polyoxy alkylene block copolymer having the constituent units as shown in formula (A), for example, a compound expressed in the following formula (B) or formula (C) may be used.

(B)

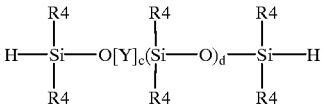

In formula (B), d and c are integers of 2 or more, R4 is a monovalent hydrocarbon group, and each R4 may be either same or different, and Y is the above formula (A).

(C)

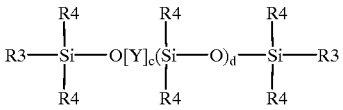

In formula (C), d and c are integers of 2 or more, R4 is a monovalent hydrocarbon group, and each R4 may be either same or different, R3 is a residual group of which monomer containing ethylenic unsaturated group is saturated by H, and Y is the above formula (A).

Examples of monomer containing ethylenic unsaturated group include (1) acrylic acid, methacrylic acid, and their derivatives (acrylic acid, methacrylic acid, methyl methacrylate, amide acrylate, acrylonitrile, n-butyl methacrylate, etc.), (2) aromatic vinyl monomer (styrene, α-methyl styrene, etc.), (3) vinyl ether monomer (vinyl methyl ether, etc.), (4) vinyl halide monomer (vinyl chloride, etc.), and (5) olefin hydrocarbon monomer (propylene, etc.). The monomer containing ethylenic unsaturated group is preferred to have epoxy group, amino group, hydroxy group, or carboxy group, and for example, acrylic acid, amide acrylate, 2,3-epoxy propyl methacrylate [$CH_2{=}C(CH_3)COOC_3H_5O$], 2-hydroxy ethyl methacrylate [$CH_2{=}C(CH_3)COOCH_2CH_2OH$], 2-hydroxy propyl methacrylate [$CH_2{=}C(CH_3)COOCH_2CH(OH)CH_3$], and 2-(diethyl amino)ethyl methacrylate [$CH_2{=}C(CH_3)COOCH_2CH_2N(C_2H_5)_2$] may be used.

Examples of polysiloxane-polyoxy alkylene block copolymer having constituent units shown in formula (A) and manufacturing method are described, for example, in Japanese Laid-open Patent No. 4-359023. For example, what is shown in formula (B) is obtained by reaction of linear polysiloxane compound having Si—H group at least at both ends and oxyalkylene compound having ethylenic unsaturated group at both ends. What is shown in formula (C) is obtained by reaction of the compound in formula (B) and monomer containing ethylenic unsaturated group (for example, acrylic acid given above).

The polysiloxane-polyoxy alkylene block copolymer has a composition having polyoxy alkylene incorporated in the main chain, so that it may be synthesized to have a high molecular weight. In the invention, the molecular weight is not particularly limited, but it is usually preferable at 10,000 to 80,000. As a result of application of this copolymer in the heat resistant lubricating layer of the ink sheet, it is found to present an excellent lubricity on the surface of the heat resistant lubricating layer more than in the prior art.

The reason of presenting an excellent lubricating characteristic is that, different from the proposed conventional ink sheet having polyoxy alkylene in the side chain, the polysiloxane of the main chain is easy to exhibit its lubricating characteristic because side chain component is hardly contained, and that the content of polysiloxane increases along with increase in the molecular weight, so that an excellent lubricity is provided on the surface of the heat resistant lubricating layer. Same as in the prior art, meanwhile, it also has the antistatic characteristic by polyoxy alkylene.

Since the polysiloxane-polyoxy alkylene block copolymer shown in formula (B) has a reaction group, it can be used in the heat resistant lubricating layer by combining with a compound having vinyl group (for example, silicone containing vinyl group, or hydrocarbon containing vinyl group), silanol denatured silicone oil, etc. As the catalyst, zinc octylate, tin octylate, dibutyl tin dilaurate, other zinc series or tin series catalyst, platinum chloride, other platinum series catalyst, peroxide catalyst, etc. may be used. It is also possible to react with ultraviolet ray, radiation, etc.

The binder of the heat resistant lubricating layer 3 is not particularly limited. As the binder of the color material layer, the above examples of resin can be used. Particularly usable are urethane resin, epoxy resin, amide resin, imide resin, epoxy acrylate resin, polyester acrylate, urethane acrylate resin, other acrylate resin, amino alkyd resin, other alkyd resin, xylene formaldehyde, and other xylene resin. What is particularly useful is saturated polyester, acryl polyol, polyester polyol, polyether polyol, polycarbonate diol, polyurethane, phenolic resin, polyvinyl acetate resin, cellulose resin, and resins having active hydrogen because they can enhanced the heat resistance by forming crosslinking structure by reaction with crosslinking agent such as isocyanate, glyoxazal, phenol, melamine, and epoxy compound.

Various silicone denatured resins and various fluorine denatured resins can be also used as the binder. Examples of silicone denatured resin include acrylic resin grafting silicone, polyester resin grafting silicone, polyurethane resin grafting silicone, and other copolymers grafting various silicones (including two- and multi-element copolymers). Examples are silicone graft polymer (tradename: SYMAC, Toagosei Chemical Industry, Co., Ltd.), acrylic resin grafting silicone (product number: X-22-8004, X-22-8009, X-22-8053, X-22-8015, X-22-8084, X-22-8019, X-22-8033, X-22-8095X, etc., Shin-etsu Chemical Co., Ltd.), and silicone-acrylic copolymer (tradename: DAIKALAC, product number 5600, Daido chemical Corp.), etc.

Various fluorine denatured resins arid various resins containing the silicone graft copolymer mentioned above and also various silicone denatured resins and perfluoroalkyl group may be also used as binder. For examples, the resins disclosed in Japanese Laid-open Patents No. 61-143195, No. 62-82086, No. 1-214475, No. 3-288680, No. 5-85070, No. 5-131769, No. 6-79978, No. 7-149068, and No. 7-149069 may be used.

These binders may be also combined. For example, a resin not containing silicone substantially, and a silicone denatured resin can be combined. By using various silicone denatured resins, or various fluorine denatured resins having active hydrogen, or using structures to have active hydrogen, and by combining with crosslinking agent such as isocyanate, a crosslinking structure may be formed to enhance the heat resistance. In particular, by using silicone graft resin, polysiloxane-polyoxy alkylene block copolymer, resin (for example, resin not containing silicone substantially), and crosslinking agent, and by using at least one selected from silicone graft resin, polysiloxane-polyoxy alkylene block copolymer and resin having hydroxyl group, a crosslinking structure may be formed.

By combining the heat resistant lubricating layer containing polysiloxane-polyoxy alkylene block copolymer further with silicone graft copolymer or various silicone denatured resins, the surface lubricity of the heat resistant lubricating layer may be further enhanced. By forming a heat resistant lubricating layer having crosslinking structure by using at least one resin having active hydrogen or hydroxy group as binder, a heat resistant lubricating layer of excellent heat resistance can be obtained.

Figure 2:
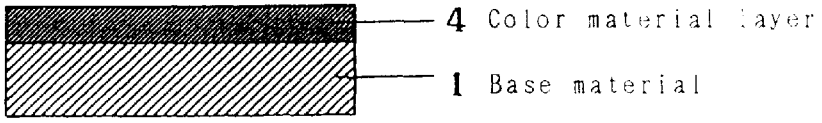
FIG. 2 and FIG. 3 are schematic sectional views of an ink sheet for sublimation type thermal transfer recording in an embodiment of the invention.
Figure 3:
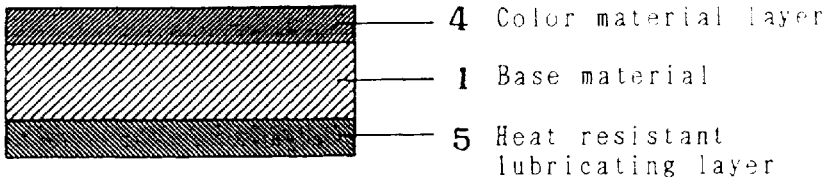

FIG. 2 and FIG. 3 are schematic sectional views of the ink sheet for sublimation type thermal transfer recording (hereinafter also called ink sheet) of the invention as an embodiment.

The ink sheet in FIG. 2 has at least a color material layer 4 on one side of a base material 1. The ink sheet in FIG. 3 has at least a color material layer 4 on one side of a base material 1, and at least a heat resistant lubricating layer 5 on the other side.

The base material 1 is not particularly limited, but, for example, the base material described in relation to the ink sheet in FIG. 1 may be used.

The heat resistant lubricating layer 5 is composed of, at least, a thermoplastic resin and lubricant, or a thermosetting resin and lubricant.

The color material layer 4 comprises at least a dye, a binder and a polysiloxane-polyoxy alkylene block copolymer. The polysiloxane-polyoxy alkylene block copolymer has constituent units as shown in formula (A) below.

(A)

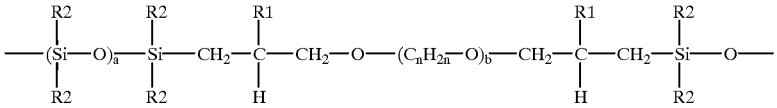

where a and b are integers of 2 or more, R1 is hydrogen atom or monovalent hydrocarbon group, R2 is a monovalent hydrocarbon group, and R1 and R2 may be either same or different, n is an integer of 2 to 4, and $(C_nH_{2n}—O)$ b unit may have two or more $(C_nH_{2n}—O)$ b units differing in the value of n, and at this time the value of b may be same or different.

As the polysiloxane-polyoxy alkylene block copolymer having the constituent units as shown in formula (A), for example, a compound expressed in the following formula (B) or formula (C) may be used.

(B)

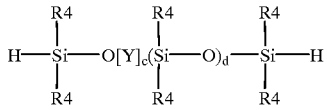

where d and c are integers of 2 or more, R4 is a monovalent hydrocarbon group, and each R4 may be either same or different, and Y is the above formula (A).

Or the compound shown in formula (C) may be also used.

(C)

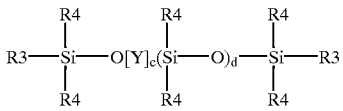

where d and c are integers of 2 or more, R4 is a monovalent hydrocarbon group, and each R4 may be either same or different, R3 is a residual group of which monomer containing ethylenic unsaturated group is saturated by H, and Y is the above formula (A).

The dye is not particularly limited, but, for example, disperse dye, acidic dye, basic dye, and oil soluble dye may be used.

The binder of the color material layer 4 is not particularly limited, but various binders, for example, mentioned in relation to the color material layer 2 in FIG. 1 may be used.

Figure 4:
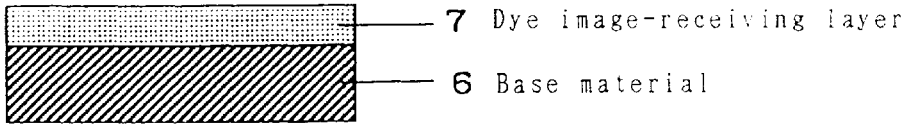
FIG. 4 and FIG. 5 are schematic sectional views of an image-receiving sheet for sublimation type thermal transfer recording in an embodiment of the invention.
Figure 5:
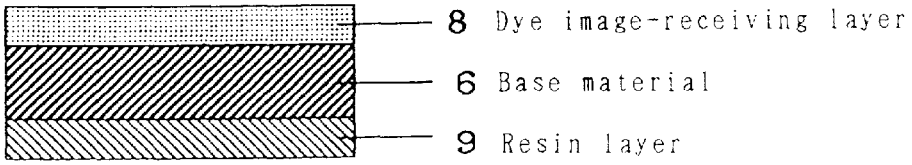

FIG. 4 and FIG. 5 are schematic sectional views of the image-receiving sheet for sublimation type thermal transfer recording (hereinafter image-receiving sheet) of the invention as an embodiment.

The image-receiving sheet in FIG. 4 has at least a dye image-receiving layer 7 on one side of a base material 6. The image-receiving sheet in FIG. 5 has at least a dye image-receiving layer 8 on one side of a base material 6, and at least a resin layer 9 on the other side.

The base material 6 is not particularly limited, but usable examples include (1) a film of polyethylene, polypropylene, or polyethylene terephthalate resin, (2) white film or other high molecular film fabricated by drawing after adding fine particles to various resins, (3) paper, art paper, cellulose, synthetic paper, or synthetic resin paper, (4) laminate of high molecular films, papers, or high molecular film and paper, or (5) anchor coated film, paper or laminate.

The dye image-receiving layer 7 is composed of at least a resin having dye affinity and a polysiloxane-polyoxy alkylene block copolymer having constituent units shown in formula (A).

The dye image-receiving layer 8 is composed of at least a resin having dye affinity and a parting agent.

The resin layer 9 is composed of at least a high molecular substance and a polysiloxane-polyoxy alkylene block copolymer having constituent units shown in formula (A).

As the polysiloxane-polyoxy alkylene block copolymer having constituent units shown in formula (A), for example, the compound shown in formula (B) or formula (C) may be used in the dye image-receiving layer 7 and resin layer 9.

As the parting agent of the dye image-receiving layer 8, silicone oil, reactive silicone oil or other may be used. Of course, as the parting agent of the dye image-receiving layer 8, the polysiloxane-polyoxy alkylene block copolymer having constituent units shown in formula (A) may be also used.

The resin having dye affinity is not particularly limited, but, for example, various resins used as the binder of the color material layer 4 may be used.

The high molecular substance of the resin layer 9 is not particularly limited, but, for example, polyethylene, polypropylene and other resin of small polarity are preferred. Usable examples are (1) acrylic series, amide series, ether series, polyester series, cellulose series, epoxy series, urethane series, imide series, and other resins, (2) epoxy acrylate, polyester acrylate, urethane acrylate, other acrylate resins, (3) alkyd resin such as amino alkyd resin, and (4) xylene resin such as xylene formaldehyde. In particular, resins having active hydrogen or hydroxy group such as saturated polyester, acryl polyol, polyester polyol, polyether polyol, polycarbonate diol, polyurethane, phenolic resin, polyvinyl acetate resin and cellulose resin react with crosslinking agents such as isocyanate, glyoxal, phenol, melamine, and epoxy compound to form a crosslinking structure, thereby enhancing the heat resistance. Besides, among crosslinking type resins, the resins high in heat resistance and hardly stained in dye are preferred.

As a result of application of the polysiloxane-polyoxy alkylene block copolymer of the invention in the color material layer of the ink sheet, the dye image-receiving layer of the image-receiving sheet, or resin layer of the image-receiving layer, it is found that the ink sheet and image-receiving sheet for sublimation type thermal transfer recording having better storage characteristic than in the prior art are obtained.

The reason why the ink sheet and image-receiving sheet excellent in storage characteristic is explained below. Polyoxy alkylene is provided in the side chain of the ink sheet proposed conventionally, and the majority of the silicone parting agent is polysiloxane in more than 99% of the main chain, and therefore the affinity of the dye of the containing layer and the resin is not so good, and the molecular weight is not so large, and therefore in the condition below room temperature or high temperature and high humidity, migration from the color material layer or dye image-forming layer to the other side in contact is likely to occur. By contrast, in the polysiloxane-polyoxy alkylene block copolymer of the invention, there is hardly any side chain component, and therefore the molecular weight can be increased. Besides, since the main chain has the polyoxylene alkyl structure, the ratio of polysiloxane in the main chain is relatively decreased, and hence the affinity for the dye, binder in the color material layer, the resin having dye affinity of the image-receiving sheet, or the high molecular substance in the resin layer is enhanced more than ever, and migration from the added layer to others hardly occurs. Besides, by the increase of the molecular weight, the polysiloxane content can be also increased, and the thermal fusion preventive characteristic between the color material layer and dye image-receiving layer may be also enhanced.

The polysiloxane-polyoxy alkylene block copolymer of the invention is also excellent in recording sensitivity also in the dye, and hence it is particularly useful in the composition containing an indoaniline dye that is likely to migrate.

The polysiloxane-polyoxy alkylene block copolymer shown in formula (B) can be used as non-reaction system, and further, for example, it can be also used as reaction system by combining with a compound containing vinyl group (for example, silicone containing vinyl group, or hydrocarbon containing vinyl group), or silanol denatured silicone oil.

The foregoing description is applied to the ink sheet and image-receiving sheet in FIG. 1 to FIG. 5.

The heat resistant lubricating layers 3, 5, color material layers 2, 5, dye image-receiving layers 7, 8, and resin layer 9 can contain fine particles or surface active agent. Besides, by containing carbon black or other conductive agent in the heat resistant lubricating layers 3, 5, they can be also used as the conductive layers for energized recording.

Fine particles are not particularly limited, but, for example, organic fine particles and inorganic fine particles can be used. For example, fine particles disclosed in Japanese Laid-open Patents No. 60-82385, No. 60-219094, No. 2-8087, No. 5-16548, No. 5-177962, and No. 6-65396 may be used. In particular, when ultrafine particles with mean particle size of primary particles of 0.5 $\mu$m are used in the heat resistant lubricating layers 3, 5, it is effective to prevent the heat resistant lubricating layer from being shaved off by the recording head, and it is hence particularly useful. As fine particles, silicone particles, fluorine particles, graphite, molybdenum disulfide and other lubricating fine particles can be used.

The surface active agent is not particularly limited. For example, various surface active agents disclosed in Japanese Laid-open Patent No. 59-196291 can be used. Especially, the ester phosphate surface active agent is preferred because it is excellent in lubricity and antistatic property. For example, the tradename Phosphanol (product number: RS-410, RS-710, RL-210, RD-510Y, GB-520; Toho Chemical Industry Co., Ltd.) is useful. The surface active agent is effective for (1) decreasing the running sound or running frictional resistance due to static electricity occurring when the ink sheet runs on the recording head, (2) preventing electric charge of the ink sheet and image-receiving sheet, and (3) preventing thermal fusion of the ink sheet and image-receiving sheet.

The blending ratio of the polysiloxane-polyoxy alkylene block copolymer and others in the binder of the heat resistant lubricating layer, binder of color material layer, resin having dye affinity of dye image-receiving layer and high molecular substance of resin layer is not particularly defined. Usually, in 100 parts by weight of the binder (or resin having dye affinity or high molecular substance), the copolymer is used in a range of 0.1 to 30 parts by weight.

The blending ratio of the color material in color material layer is not particularly limited. For example, in the case of the color material layer of the ink sheet for sublimation type thermal transfer recording, usually, in 100 parts by weight of the binder, the dye is used in a range of 25 to 150 parts by weight.

The blending ratio of fine particles is not particularly limited. Usually, in 100 parts by weight of the binder (or resin having dye affinity or high molecular substance), fine particles may be used in a range of 0.1 to 50 parts by weight.

The blending ratio of the surface active agent is not particularly limited. Usually, in 100 parts by weight of the binder (or resin having dye affinity or high molecular substance), the surface active agent may be used in a range of 0.1 to 30 parts by weight. Meanwhile, the ink sheet and image-receiving sheet are commonly defined as the medium.

Specific embodiments are illustrated below. The polysiloxane-polyoxy alkylene block copolymer used in the embodiments are shown in Table 1 and Table 2.

The dyes used in the embodiments are shown in Table 3 and Table 4.

As the color material, a dye having at least one of cyan color, magenta color, and yellow color is used.

The number of color material layers is not limited to one, but plural layers may be set.

For example, three layers of cyan color material layer, magenta color material layer, and yellow color material layer can be composed.

TABLE 1

| Symbol | Chemical formula (where Me = $CH_3$) | Weight-average molecular weight |
|---|---|---|
| F1 | $HMe_2SiO—[(Me_2SiO)_{30}Me_2Si—CH_2CH(CH_3)CH_2O(C_2H_4O)_{14}—(C_3H_6O)_{20}CH_2CH(CH_3)CH_2—Me_2SiO]_n—(Me_2SiO)_{30}SiMe_2H$ | Approx. 32000 |
| F2 | $HMe_2SiO—[(Me_2SiO)_{40}Me_2Si—CH_2CH(CH_3)CH_2O(C_2H_4O)_{20}—(C_3H_6O)_{28}CH_2CH(CH_3)CH_2—Me_2SiO]_n—(Me_2SiO)_{40}SiMe_2H$ | Approx. 55000 |
| F3 | $HOC(=O)CH_2CH_2Me_2SiO—[(Me_2SiO)_{30}—Me_2SiCH_2CH(CH_3)CH_2O—(C_2H_4O)_{18}(C_3H_6O)_{20}CH_2CH(CH_3)—CH_2—Me_2SiO]_n—(Me_2SiO)_{30}—SiMe_2CH_2CH_2C(=O)OH$ | Approx. 52000 |

TABLE 2

| Symbol | Chemical formula (where Me = $CH_3$) | Weight-average molecular weight |
|---|---|---|
| F4 | $HOC(=O)CH_2CH_2Me_2SiO—[(Me_2SiO)_{40}—Me_2SiCH_2CH(CH_3)CH_2O—(C_2H_4O)_{18}(C_3H_6O)_{20}CH_2CH(CH_3)—CH_2—Me_2SiO]_n—(Me_2SiO)_{40}—SiMe_2CH_2CH_2C(=O)OH$ | Approx. 73000 |
| F5 | $CH_2(O)CHCH_2OC(=O)CH(CH_3)CH_2—Me_2SiO—[(Me_2SiO)_{30}—Me_2SiCH_2CH(CH_3)CH_2O—(C_2H_4O)_{18}(C_3H_6O)_{20}CH_2CH(CH_3)—CH_2—Me_2SiO]n—(Me_2SiO)_{30}—SiMe_2CH_2CH(CH_3)C(=O)OCH_2CH(O)CH_2$ | Approx. 43000 |
| F6 | $CH_3CH(OH)CH_2OC(=O)CH_2CH_2—Me_2SiO—[(Me_2SiO)_{30}—Me_2SiCH_2CH(CH_3)CH_2O—(C_2H_4O)_{18}(C_3H_6O)_{30}CH_2CH(CH_3)—CH_2—Me_2SiO]n—(Me_2SiO)_{30}—SiMe_2CH_2CH_2C(=O)OCH_2CH(OH)CH_3$ | Approx. 34000 |

TABLE 3

| Symbol | Chemical structure |
|---|---|
| P1 | 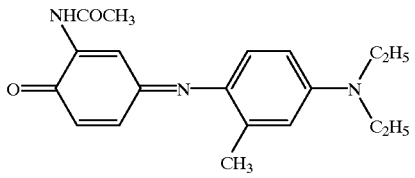 |
| P2 | 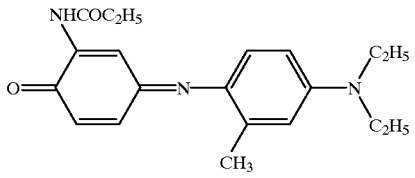 |
| P3 | 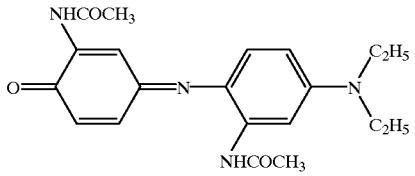 |
| P4 | 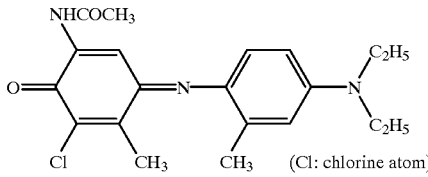 (Cl: chlorine atom) |
| P5 | 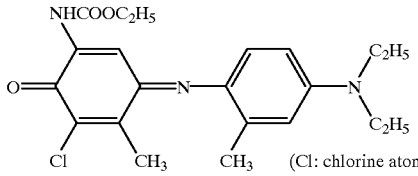 (Cl: chlorine atom) |

TABLE 4

| Symbol | Chemical structure |
|---|---|
| M1 | 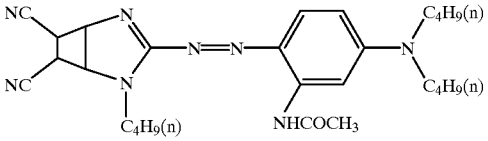 |
| Y1 | 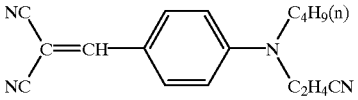 |

(Embodiment 1)

On an anchor coat layer of a PET film (4.5 μm thick) having an anchor coat layer (about 0.1 μm thick) made of urethane resin on the upper surface, the following color material layer paint was applied by microgravure coater. Then drying in hot air at 100° C., a color material layer was formed. On the lower surface of the PET film, the following heat resistant lubricating layer paint was similarly applied by microgravure coater, and then drying in hot air at 100° C., a heat resistant lubricating layer was formed. In this way, an ink sheet was prepared. The film thickness is 0.8 μm in the color material layer, and about 1.5 μm in the heat resistant lubricating layer.

| (Color material layer paint) | |
|---|---|
| Acrylonitrile-styrene copolymer (AS-S, Denki Kagaku Kogyo K.K.) | 8 parts by weight |
| Paint (symbol P1 in Table 3) | 5 parts by weight |
| 2-Butanone | 50 parts by weight |
| Toluene | 50 parts by weight |
| **(Heat resistant lubricating layer paint)** | |
| Polyvinyl acetal resin (KS-5, Sekisui Chemical Co., Ltd.) | 14 parts by weight |
| Polysiloxane-polyoxy alkylene block copolymer (symbol F1 in Table 1) | 1 part by weight |
| 2-Butanone | 80 parts by weight |
| Toluene | 20 parts by weight |

This ink sheet was joined together with a commercial image-receiving sheet (video print set, product number VW-MPS50, Matsushita Electric Industrial Co., Ltd.), and both sheets were placed between a thermal head and a platen, and recording was conducted in the following recording condition.

| | |
|---|---|
| Recording density of main and sub scanning | 6 dots/mm |
| Recording heat | variable |
| Recording period | 16 ms/line |
| Head heating time | 4 ms |
| Recording length | 100 mm |

As a result of repeating same record three times at recording heat of 6 J/cm$^2$, neither sticking nor crease occurred in three tests, and the ink sheet traveled on the thermal head favorably. Next, a newly fabricated ink sheet was wound on a test tube of about 17 mm in outside diameter, and stored in a thermostatic oven at 50° C. and 60% RH for 15 days, and similar running test was conducted. As a result, same as before storage, after three tests at recording heat of 6 J/cm$^2$, neither sticking nor crease occurred, and the ink sheet traveled on the thermal head favorably.

(Embodiment 2)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Polyvinyl acetal resin (KS-5) | 14 parts by weight |
| Polysiloxane-polyoxy alkylene block copolymer (symbol F1 in Table 1) | 1 part by weight |
| Dibutyl tin dilaurate | 0.01 part by weight |
| 2-Butanone | 80 parts by weight |
| Toluene | 20 parts by weight |

Same as in embodiment 1, as a result of same recording repeated three times at recording heat of 6 J/cm$^2$, neither sticking nor creased occurred in three tests, and the ink sheet traveled on the thermal head favorably. Also same as in embodiment 1, after storage for 15 days at 50° C. and 60% RH, recording was repeated three times at recording heat of 6 J/cm$^2$, and neither sticking nor crease occurred, and the thermal head traveled on the thermal head favorably.

(Embodiment 3)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Polyvinyl acetal resin (KS-5) | 14 parts by weight |
| Polysiloxane-polyoxy alkylene block copolymer (symbol F2 in Table 1) | 0.8 part by weight |
| Silanol denatured silicone oil (L-9000 (100), Nippon Unicar Co., Ltd.) | 0.2 part by weight |
| Dibutyl tin dilaurate | 0.01 part by weight |
| 2-Butanone | 80 parts by weight |
| Toluene | 20 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 4)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

(Heat resistant lubricating layer paint)

| (Heat resistant lubricating layer paint) | |
|---|---|
| Polyvinyl acetal resin (KS-5) | 14 parts by weight |
| Polysiloxane-polyoxy alkylene block copolymer (symbol F3 in Table 1) | 1 part by weight |
| 2-Butanone | 80 parts by weight |
| Toluene | 20 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 5)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Polyvinyl acetal resin (KS-5) | 14 parts by weight |
| Polysiloxane-polyoxy alkylene block copolymer (symbol F3 in Table 1) | 1 part by weight |
| Polyisocyanate (Coronate L, Nippon Polyurethane Industry Co., Ltd.) | 2.1 parts by weight |
| 2-Butanone | 80 parts by weight |
| Toluene | 20 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 6)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Acrylpolyol (A-801, solid content 50 wt. %, Dainippon Ink and Chemicals, Inc.) | 30 parts by weigth |
| Polysiloxane-polyoxy alkylene block copolymer (symbol F3 in Table 1) | 1 part by weight |
| Polyisocyanate (Coronate L) | 5 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 7)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Acrylpolyol (A-801) | 30 parts by weigth |
| Polysiloxane-polyoxy alkylene block copolymer (symbol F4 in Table 2) | 0.75 part by weight |
| Polyisocyanate (Coronate L) | 5 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 8)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Acrylpolyol (A-801) | 30 parts by weigth |
| Polysiloxane-polyoxy alkylene block copolymer (symbol F5 in Table 2) | 1 part by weight |
| Polyisocyanate (Coronate L) | 5 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 9)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Acrylpolyol (A-801) | 30 parts by weigth |
| Polysiloxane-polyoxy alkylene block copolymer (symbol F6 in Table 2) | 1 part by weight |
| Polyisocyanate (Coronate L) | 8 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 10)

On the lower surface of a PET film forming a color material layer on the upper surface same as in embodiment 1, the following heat resistant lubricating layer paint was applied in a same manner as in embodiment 1, and an ink sheet was prepared. The thickness of the heat resistant lubricating layer is about 1.5 μm.

| (Heat resistant lubricating layer paint) | |
|---|---|
| Acrylpolyol (A-801) | 15 parts by weigth |
| Polysiloxane-polyoxy alkylene block copolymer (symbol F3 in Table 1) | 0.7 part by weight |
| Silicone graft acrylic resin (X-22-8004, solid content 40 wt. %, OH group contained, Shin-etsu Chemical Co., Ltd.) | 15 parts by weight |
| Dimethyl silicone oil (L-45 (500), Nippon Unicar Co., Ltd.) | 0.5 part by weight |
| Polyisocyanate (Coronate L) | 5 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1.

(Embodiment 11)

On the lower surface of a PET film forming a color material layer on the upper surface same as in embodiment 1, the following heat resistant lubricating layer paint was applied in a same manner as in embodiment 1, and an ink sheet was prepared. Hydrophobic silica was dispersed in a solvent by ultrasonic wave generating machine, and then the heat resistant lubricating layer paint was blended. The thickness of the heat resistant lubricating layer is about 1.5 μm.

| (Heat resistant lubricating layer paint) | |
|---|---|
| Acrylpolyol (A-801) | 15 parts by weigth |
| Polysiloxane-polyoxy alkylene block copolymer (symbol F3 in Table 1) | 0.7 part by weight |
| Silicone graft acrylic resin (X-22-8004) | 15 parts by weight |
| Dimethyl silicone oil (L-45 (500), Nippon Unicar Co., Ltd.) | 0.5 part by weight |
| Polyisocyanate (Coronate L) | 5 parts by weight |
| Hydrophobic silica (R972, Nippon Aerosil Co., Ltd.) | 2.4 parts by weight |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1. Besides, after repeating same recording 50 times, there was no dropout of image due to head contamination.

(Embodiment 12)

On the lower surface of a PET film forming a color material layer on the upper surface same as in embodiment 1, the following heat resistant lubricating layer paint was applied in a same manner as in embodiment 1, and an ink sheet was prepared. Hydrophobic silica was dispersed in a solvent by ultrasonic wave generating machine, and then the heat resistant lubricating layer paint was blended. The thickness of the heat resistant lubricating layer is about 1.5 μm.

| (Heat resistant lubricating layer paint) | |
|---|---|
| Acrylpolyol (A-801) | 15 parts by weigth |
| Polysiloxane-polyoxy alkylene block copolymer (symbol F3 in Table 1) | 0.7 part by weight |
| Silicone graft acrylic resin (X-22-8004) | 15 parts by weight |
| Dimethyl silicone oil (L-45 (500), Nippon Unicar Co., Ltd.) | 0.5 part by weight |
| Polyisocyanate (Coronate L) | 5 parts by weight |
| Hydrophobic silica (R972, Nippon Aerosil Co., Ltd.) | 2.4 parts by weight |
| Surface active agent (RL-210, Toho Chemical Industry Co., Ltd.) | |
| 2-Butanone | 50 parts by weight |
| Toluene | 50 parts by weight |

Same as in embodiment 1, as a result of same recording repeated three times at recording heat of 6 J/cm$^2$, the traveling performance of this ink sheet was favorable both before and after storage same as in embodiment 1. Besides, after repeating same recording 50 times, there was no dropout of image due to head contamination.

(Embodiment 13)

On the upper surface of a PET film (4 μm thick), the following color material layer paint was applied by microgravure coater, and then drying in hot air at 100° C., a color material layer was formed. On the lower surface of the PET film, the following heat resistant lubricating layer paint was similarly applied by microgravure coater, and then drying in hot air at 100° C., a heat resistant lubricating layer was formed. In this way, an ink sheet was prepared. The film thickness is 3 μm in the color material layer, and 1 μm in the heat resistant lubricating layer.

| (Color material layer paint) | |
|---|---|
| Wax (Had-5090, Nippon Seiro Co., Ltd.) | 3.5 parts by weight |
| Hydrocarbon resin (P-70, Arakawa Chemical Industries Co., Ltd.) | 0.25 part by weight |
| Terpene resin (Px100, Yasuhara Yushi Kogyo Co., Ltd.) | 0.25 part by weight |
| Carbon black powder | 0.75 part by weight |
| 2-Propanol | 8 parts by weight |
| Toluene | 30 parts by weight |

(Heat resistant lubricating layer paint)

The composition of the heat resistant lubricating layer paint is same as in embodiment 4.

This ink sheet was slit in a width of 12 mm, and assembled into a cassette for serial printer, and printed on plain paper by a commercial word processor (Ulpro701, Matsushita Electric Industrial Co., Ltd.) As a result, the serial head traveled favorably, and characters were printed clearly.

(Embodiment 14)

On the lower surface of a PET film (4.5 μm thick) having an anchor coat layer (about 0.1 μm thick) made of urethane resin on the upper surface, the following heat resistant lubricating layer paint was applied by microgravure coater, and then drying in hot air at 100° C., a heat resistant lubricating (about 1.1 μm thick) layer was formed, and thus a PET film with heat resistant lubricating layer was prepared (coating length: about 2000 m). On the anchor coat layer of this PET film with heat resistant lubricating layer, the following C color material layer paint (short for cyan color material layer paint) and Y color material layer paint (short for yellow color material layer paint) were applied by microgravure coater so that the C and Y color material layers be alternately repeated sequentially, and then drying in hot air at 100° C., an ink sheet was prepared (length of single color material layer of C and Y: about 160 mm, length of uncoated portion between C and Y color material layers: about 10 mm, coating length: about 30 m). The film thickness is 0.9 μm in both color material layers.

| (Heat resistant lubricating layer paint) | |
|---|---|
| Polyvinyl acetal resin (KS-5) | 10 parts by weight |
| Silicone graft acrylic resin (X-22-8004) | 25 parts by weight |
| Amino denatured silicone oil (KF857, Shin-etsu Chemical Co., Ltd.) | 1 part by weight |
| Epoxy denatured silicone oil (X-60-164, Shin-etsu Chemical Co., Ltd.) | 1 part by weight |
| 2-Butanone | 60 parts by weight |
| Toluene | 40 parts by weight |
| **(C color material layer paint)** | |
| Acrylonitrile-styrene copolymer (AS-S) | 8 parts by weight |
| Paint (symbol P1 in Table 3) | 5.6 parts by weight |
| Polysiloxane-polyoxy alkylene block copolymer (symbol F1 in Table 1) | 0.2 part by weight |
| 2-Butanone | 50 parts by weight |
| Toluene | 50 parts by weight |

-continued

| (Y color material layer paint) | |
|---|---|
| Acrylonitrile-styrene copolymer (AS-S) | 8 parts by weight |
| Paint (symbol Y1 in Table 4) | 4 parts by weight |
| Polysiloxane-polyoxy alkylene block copolymer (symbol F1 in Table 1) | 0.2 part by weight |
| 2-Butanone | 50 parts by weight |
| Toluene | 50 parts by weight |

Consequently, on an anchor coat layer of a white PET film (about 100 μm thick) having an isocyanate crosslink polyester anchor coat layer (about 0.1 μm thick) on the upper surface, the following dye image-receiving layer paint was applied by microgravure coater, and then drying in hot air at 100° C., a dye image-receiving layer (about 3 μm thick) was formed. In this way, an image-receiving sheet was prepared.

| (Dye image-receiving layer paint) | |
|---|---|
| Polyvinyl butyral resin (BL-3, Sekisui Chemical Co., Ltd.) | 10 parts by weight |
| Amino denatured silicone oil (KF857) | 0.5 part by weight |
| Epoxy denatured silicone oil (X-60-164) | 0.5 part by weight |
| 2-Butanone | 50 parts by weight |
| Toluene | 30 parts by weight |

Thus prepared ink sheet was slit in a width of 98 mm, and the slit ink sheet was wound about a BAKELITE resin bobbin of about 30 mm in outside diameter by about 20 m, and stored in a thermostatic oven at 50° C. and 60% RH for 10 days. Then the C color material layer of the ink sheet was joined with the image-receiving sheet, and the both sheets were placed between a thermal head and a platen, and recording was conducted in the following recording condition.

| | |
|---|---|
| Recording density of main and sub scanning | 6 dots/mm |
| Recording heat | variable |
| Recording period | 16 ms/line |
| Head heating time | 4 ms |
| Recording length | 100 mm |

As a result of recording of a cyan single color image on the dye image-receiving layer of the image-receiving sheet at recording heat of 5 J/cm$^2$ (recording density 2.06, as measured by Macbeth densitometer), yellow color mixing was not found in the cyan image. Similarly, the Y color material layer and image-receiving sheet were joined, and a yellow single color image was recorded (recording density 2.09), and cyan color mixing was not found in the yellow image. When the C color material layer and Y color material layer were used again 10 days later to prepare an ink sheet, the same favorable characteristics as above were obtained.

(Embodiment 15)

Image-receiving sheet: The image-receiving sheet of embodiment 14 was used.

Ink sheet: On the anchor coat layer of a polyimide film (120 mm wide, about 4 μm thick) having an anchor coat layer (about 0.1 μm thick) made of urethane resin on the upper surface, the C color material layer paint and Y color material layer paint of embodiment 14 were applied by microgravure coater so that the both color material layers be alternately repeated sequentially, and then drying in hot air at, 100° C., an ink sheet was prepared (length of each color material: about 160 mm, length of uncoated portion between C and Y color material layers: about 10 mm, coating length: about 100 m). The film thickness is 0.8 μm in both color material layers.

This ink sheet was slit in a width of 98 mm, and stored in a thermostatic oven at 50° C. and 60% RH for 10 days same as in embodiment 14, and the C color material layer of the ink sheet and the image-receiving sheet of embodiment 14 were joined together, and recording was conducted in the same recording condition as in embodiment 14.

As a result, yellow color mixing was not, found in the cyan single color image (recording density 2.14), and cyan color mixing was not found in the yellow single color image (recording density 2.23)

(Embodiments 16 to 20)

Image-receiving sheet: The image-receiving sheet in embodiment 14 was used.

On the anchor coat layer of the PET film with heat resistant lubricating layer (prepared in embodiment 14), a C color material layer paint and a Y color material layer paint were applied same as in embodiment 14, except that only the polysiloxane-polyoxy alkylene block copolymer (symbol F1 in Table 1) in the C color material layer paint and Y color material paint in embodiment 14 was changed to symbol F2 in Table 1, and an ink sheet was prepared. The obtained ink sheet was stored, same as in embodiment 14, for 10 days in a thermostatic oven at 50° C. and 60% RH, and the storage test of the ink sheet was conducted. As a result, same as in embodiment 14, color mixing was not found in each one of C and Y single color images (embodiment 16).

Similarly, ink sheets were prepared by replacing only the polysiloxane-polyoxy alkylene block copolymer (symbol F1 in Table 1) in the C color material layer paint and Y color material paint in embodiment 14 with polysiloxane-polyoxy alkylene block copolymers of symbol F3 in Table 1 and F4 to 16 in Table 2. An ink sheet containing the copolymer F3 in the C color layer and Y color layer, similarly, an ink sheet containing the copolymer F4, an ink sheet containing the copolymer F5, and an ink sheet containing the copolymer F6 were investigated. As a result, also when using the polysiloxane-polyoxy alkylene block copolymers of F3 to F6, same as in embodiment 14, color mixing was not found in each one of C and Y single color images, and favorable results were obtained (embodiments 17 to 20).

(Embodiment 21)

Image-receiving sheet: The image-receiving sheet in embodiment 14 was used.

On the anchor coat layer of the PET film with heat resistant lubricating layer prepared in embodiment 14, the following C color material layer paint and Y color material layer paint were applied same as in embodiment 14, and an ink sheet was prepared. The obtained ink sheet was stored, same as in embodiment 14, for 10 days in a thermostatic oven at 50° C. and 60% RH, and the storage test of the ink sheet was conducted. As a result, same as in embodiment 14, color mixing was not found in each one of C single color image (recording density 1.71) and Y single color image (recording density 2.10).

| (C color material layer paint) | |
|---|---|
| Acrylonitrile-styrene copolymer (AS-S) | 8 parts by weight |
| Paint (symbol P3 in Table 3) | 6 parts by weight |
| Polysiloxane-polyoxy alkylene block copolymer (symbol F6 in Table 2) | 0.2 part by weight |

-continued

| | |
|---|---|
| 2-Butanone | 50 parts by weight |
| Toluene | 50 parts by weight |

(Y color material layer paint)

| | |
|---|---|
| Acrylonitrile-styrene copolymer (AS-S) | 8 parts by weight |
| Paint (symbol Y1 in Table 4) | 4 parts by weight |
| Polysiloxane-polyoxy alkylene block copolymer (symbol F6 in Table 2) | 0.2 part by weight |
| 2-Butanone | 50 parts by weight |
| Toluene | 50 parts by weight |

(Embodiment 22)

Image-receiving sheet: The image-receiving sheet in embodiment 14 was used.

On the anchor coat layer of the PET film with heat resistant lubricating layer prepared in embodiment 14, a C color material layer paint replacing only the cyan dye (symbol P3 in Table 3) in the C color material layer paint in embodiment 21 with a cyan dye (symbol P4 in Table 3) and the Y color material layer paint in embodiment 21 were applied same as in embodiment 14, and an ink sheet was prepared. The obtained ink sheet was stored, same as in embodiment 14, for 10 days in a thermostatic oven at 50° C. and 60% RH, and the storage test of the ink sheet was conducted. As a result, same as in embodiment 14, color mixing was not found in each one of C single color image (recording density 1.82) and Y single color image (recording density 2.10).

(Embodiment 23)

Image-receiving sheet: The image-receiving sheet in embodiment 14 was used.

On the anchor coat layer of the PET film with heat resistant lubricating layer prepared in embodiment 14, a C color material layer paint replacing only the cyan dye (symbol P3 in Table 3) in the C color material layer paint in embodiment 21 with a cyan dye (symbol P5 in Table 3) and the Y color material layer paint in embodiment 21 were applied same as in embodiment 14, and an ink sheet was prepared. The obtained ink sheet was stored, same as in embodiment 14, for 10 days in a thermostatic oven at 50° C. and 60% RH, and the storage test of the ink sheet was conducted. As a result, same as in embodiment 14, color mixing was not found in each one of C single color image (recording density 1.79) and Y single color image (recording density 2.11).

(Embodiment 24)

On the anchor coat layer of the PET film with heat resistant lubricating layer prepared in embodiment 14, the following C color material layer paint was applied by microgravure coater, and then drying in hot air at 100° C., an ink sheet was prepared (coating length: about 20 m). The film thickness of the color material layer is about 0.9 μm.

(C color material layer paint)

| | |
|---|---|
| Acrylonitrile-styrene copolymer (AS-S) | 7 part by weight |
| Vinyl chloride-vinyl acetate copolymer (S-LEC C, Sekisui Chemical Co., Ltd.) | 1 part by weight |
| Paint (symbol P1 in Table 3) | 5.6 parts by weight |
| 2-Butanone | 50 parts by weight |
| Toluene | 50 parts by weight |

Consequently, on the anchor coat layer of the white PET film in embodiment 14, the following dye image-receiving layer paint was applied by microgravure coater, and then drying in hot air at 100 deg. DC, a dye image-receiving layer (about 3 μm thick) was formed. Thus, an image-receiving sheet was prepared.

(Dye image-receiving layer paint)

| | |
|---|---|
| Polyvinyl butyral resin (BL-3) | 10 parts by weight |
| Polysiloxane-polyoxy alkylene block copolymer (symbol F1 in Table 1) | 0.5 part by weight |
| 2-Butanone | 50 parts by weight |
| Toluene | 30 parts by weight |

Thus prepared ink sheet and image-receiving sheet were joined together, and the both were placed between a thermal head and a platen, and recording was conducted in the same condition as in embodiment 14. After recording, the ink sheet was easily separated from the image-receiving sheet, and no thermal fusion occurred between the ink sheet and the image-receiving sheet. Then, the image-receiving sheet having this cyan recording image (recording density 2.05) was stored in a thermostatic oven for 10 days at 50° C. and 60% RH, and taken out, and the same position in the boundary of image recorded portion and unrecorded portion was rubbed three times by an index finger cleaned in ethanol. As a result, the unrecorded portion was not stained by the dye in the recorded portion, and the dye fixing performance was excellent. When the dye image-receiving layer paint was used again 10 days later to prepare an image-receiving sheet, the same favorable characteristics as above were obtained.

(Embodiments 25 to 28)

Image-receiving sheet: The image-receiving sheet of embodiment 24 was used.

Ink sheet: On the anchor coat layer of the white PET film in embodiment 14, a dye image-receiving layer paint replacing only the polysiloxane-polyoxy alkylene block copolymer (symbol F1 in Table 1) in the dye image-receiving layer paint in embodiment 24 with symbol F2 in Table 1 was applied same as in embodiment 24, and an ink sheet was prepared. Similarly, dye image-receiving layer paints replacing only the polysiloxane-polyoxy alkylene block copolymer (symbol F1 in Table 1) in the dye image-receiving layer paint in embodiment 24 with symbol F3 in Table 1, and symbols F4 and F4 in Table 3 (that is, three dye image-receiving layer paints F3 to F5) were applied same as in embodiment 24, and ink sheets were prepared.

The four image-receiving sheets prepared same as in embodiment 24 were evaluated for thermal fusion and finger touch after storage. (The density of recorded image of each one of the four image-receiving sheets was in a range of 2.04 to 2.06). As a result, same as in embodiment 24, the four image-receiving sheets were favorable in all evaluations.

(Embodiment 29)

Ink sheet: The ink sheet in embodiment 24 was used.

Image-receiving sheet: On the anchor coat layer of the white PET film of embodiment 14, a dye image-receiving layer paint replacing only the polysiloxane-polyoxy alkylene block copolymer (symbol F1 in Table 1) in the dye image-receiving layer paint in Embodiment 24 with symbol F6 in Table 2 was applied same as in embodiment 24, and an image-receiving sheet was prepared. Thereafter, same as in embodiment 24, the thermal fusion and finger touch after storage were evaluated (recording image density, 2.04). As a result, all evaluations were favorable same as in embodiment 24.

(Embodiments 30 to 33)

Image-receiving sheet: The ink sheet in embodiment 29 was used.

Ink sheet: Preparing C color material layer paints replacing only the cyan paint (P1 in Table 3) in the C color material layer paint in embodiment 24 with symbols P2 to P5 in Table 3 (that is, color material layer paint containing P2 dye, color material layer paint containing P3 dye, and so forth), ink sheets differing only in the dye in the color material layer were prepared same as in embodiment 24 (coating length: about 20 m each). The film thickness of each color material layer was about 0.9 μm.

Using this image-receiving sheet and four ink sheets, same as in embodiment 24, the thermal fusion and finger touch after storage were evaluated. As a result, thermal fusion was not observed in any one of the ink sheet having the P2 dye in the color material layer to the ink sheet having P5 dye in the color material layer. The finger touch evaluation in the cyan dye images of P2 to P5 (recording density in each dye, P2: 1.84, P3: 1.69, P4: 1.80, P5: 1.78) was favorable as in embodiment 24.

(Embodiment 34)

Image-receiving sheet: The ink sheet in embodiment 29 was used.

Ink sheet: On the anchor coat layer of the PET film with heat resistant lubricating layer prepared in embodiment 14, the following M color material layer paint (short for magenta color material layer paint) was applied by microgravure coater, and then drying in hot air at 100° C., an ink sheet was prepared (coating length: about 20 m). The film thickness of the color material layer was about 0.9 μm.

| (M color material layer paint) | |
|---|---|
| Acrylonitrile-styrene copolymer (AS-S) | 7 parts by weight |
| Vinyl chloride-vinyl acetate copolymer (S-LEC C) | 1 part by weight |
| Paint (symbol M1 in Table 4) | 6 parts by weight |
| 2-Butanone | 50 parts by weight |
| Toluene | 50 parts by weight |

Using the image-receiving sheet and ink sheet, recording and evaluation were conducted same as in embodiment 24. As a result, no thermal fusion occurred between the ink sheet and the image-receiving sheet. Then, the image-receiving sheet having the magenta image (recording density 2.0) was stored in a thermostatic oven for 10 days at 50° C. and 60% RH, and taken out, and the same position in the boundary of image recorded portion and unrecorded portion was rubbed three times by an index finger cleaned in ethanol, but the unrecorded portion was not stained by the dye in the recorded portion.

(Embodiment 35)

Ink sheet: The ink sheet in embodiment 24 was used.

Image-receiving sheet: On the anchor coat layer on the white PET film (about 100 μm thick) having isocyanate crosslinked polyester anchor coat layers (about 0.1 μm thick) on both upper and lower surfaces, a dye image-receiving layer paint in the following composition was dispersed ultrasonically and applied by microgravure coater, and then drying in hot air at 100° C., a dye image-receiving layer was formed, and further the following resin layer paint was similarly applied on the anchor coat layer of the lower surface. Thus, an image-receiving sheet having a dye image-receiving layer (about 3 μm thick) on the upper surface and a resin layer (about 5 μm thick) on the lower surface was fabricated.

| (Dye image-receiving layer paint) | |
|---|---|
| Polyvinyl butyral resin (BL-3) | 10 parts by weight |
| Polysiloxane-polyoxy alkylene block copolymer (symbol F1 in Table 1) | 0.5 part by weight |
| Calcium carbonate (Homocal D, mean particle size 0.07 μm, Shiraishi Kogyo Kaisha, Ltd.) | 1 part by weight |
| 2-Butanone | 50 parts by weight |
| Toluene | 30 parts by weight |
| (Resin layer paint) | |
| Methacrylic paint (Acripet VH, Mitsubishi Rayon Co., Ltd.) | 10 parts by weight |
| Polysiloxane-polyoxy alkylene block copolymer (symbol F1 in Table 1) | 0.5 part by weight |
| Acetone | 40 parts by weight |
| Toluene | 20 parts by weight |

The ink sheet prepared in embodiment 24 and this image-receiving sheet were joined, both sheets were placed between a thermal head and a platen, and recording was conducted in the same recording condition as in embodiment 14. Thus, an image-receiving sheet recording a cyan image (recording density 2.02) on the dye image-receiving layer was obtained. Similarly, further two image-receiving sheet recording a cyan image were fabricated. These three image-receiving sheets were laminated so that the image surface of each image-receiving sheet be upward, and three image-receiving sheets were placed between glass plates of about 5 mm in thickness, and a weight of 500 g was placed on the top glass plate, the image-receiving sheets were maintained at load condition, and were stored for 10 days in a thermostatic oven at 50° C. and 60% RH. They were taken out and observed, and as a result migration of dye of cyan color from the dye image-receiving layer was not visible at all on the resin layer at the lower side of the image-receiving sheet. When the resin layer paints were used again 10 days later to prepare image-receiving sheets, favorable characteristics were obtained same as above.

(Embodiments 36 to 40)

Ink sheet: The ink sheet in embodiment 24 was used.

Image-receiving sheet: Using a dye image-receiving layer paint and a resin layer paint replacing only the polysiloxane-polyoxy alkylene block copolymer (symbol F1 in Table 1) in the dye image-receiving layer paint and resin layer paint in embodiment 35 with symbol F2 in Table 1, an image-receiving sheet having a dye image-receiving layer (about 3 μm thick) on the upper surface and a resin layer (about 5 μm thick) on the lower surface was prepared. Similarly, using dye image-receiving layer paints (four kinds: F3 to F6) and resin layer paints (four kinds, similarly: F3 to F6) replacing only the polysiloxane-polyoxy alkylene block copolymer (symbol F1in Table 1) in the dye image-receiving layer paint and resin layer paint in embodiment 35 with symbol F3 in Table 1, F4, F5, F6 in Table 2, four image-receiving sheets having a dye image-receiving layer (about 3 μm thick) on the upper surface and a resin layer (about 5 μm thick) on the lower surface were prepared.

Using the ink sheet of embodiment 24, recording images were formed on each of one five image-receiving sheets same as in embodiment 35 (recording image density all in a range of 2.00 to 2.03), and storage test was conducted. As a result, in any image-receiving sheet, cyan color dye migration from the dye image-receiving layer to the resin layer of the lower surface was not recognized, and the lubricity between image-receiving sheet and image-receiving sheet was favorable in all image-receiving sheets.

(Embodiments 41 to 44)

Image-receiving sheet: The image receiving sheet of embodiment 40 was used (containing symbol F6 in Table 2 as polysiloxane-polyoxy alkylene block copolymer in the dye image-receiving layer and resin layer).

Ink sheet: Using a paint replacing only the cyan dye (symbol P1 in Table 3) in the C color material layer paint in embodiment 24 with cyan dye (symbol P2 in Table 3), an ink sheet containing C color material layer was prepared same as in embodiment 24. Similarly using paints P3, P4, P5 replacing only the cyan dye (symbol P1 in fable 3) in the C color material layer paint in embodiment 24 with cyan dyes (symbol P3 in Table 3), (P4 in Table 3), and (P5 in Table 3), three ink sheets were prepared same as in embodiment 24, that is, an ink sheet having paint P3 as color material layer, an ink sheet having paint P4 as color material layer, and an ink sheet having paint P5 as color material layer.

The image-receiving sheet and color material layer were combined with the ink sheet having cyan dye of P2, and recording was conducted same as in embodiment 35, and three image-receiving sheets having recording image (recording density 1.80) of cyan dye (P2) were prepared. As a result of storage test same as in embodiment 35, in any image-receiving sheet, cyan color dye migration from the dye image-receiving layer into the resin layer of the lower surface was not recognized visually.

Thereafter, a combination of image-receiving sheet and color material layer with an ink sheet having cyan dye P3 (recording image density 1.68), a combination of image-receiving sheet and color material layer with an ink sheet having cyan dye P4 (recording image density 1.76), and a combination of image-receiving sheet and color material layer with an ink sheet having cyan dye P5 (recording image density 1.75) were similarly evaluated, and in any cyan dye, cyan color dye migration from the dye image-receiving layer into the resin layer of the lower surface was not recognized visually.

(Embodiment 45)

Image-receiving sheet: The image-receiving sheet of embodiment 40 was used.

Ink sheet: The ink sheet of embodiment 34 was used.

The image-receiving sheet and ink sheet were combined, and a recording image (recording density 1.96) was formed on the image-receiving sheet same as in embodiment 35, and the storage test was conducted. As a result, magenta color dye migration from the dye image-receiving layer into the resin layer of the image-receiving sheet was not recognized at all visually.

COMPARATIVE EXAMPLE 1

On the lower surface of the PET film forming the color material layer of embodiment 1 on the upper surface, the following heat resistant lubricating layer paint was applied same as in embodiment 1, and an ink sheet was prepared. The film thickness of the heat resistant lubricating layer is about 1.5 $\mu$m.

| (Heat resistant lubricating layer paint) | |
|---|---|
| Polyvinyl acetal resin (KS-5) | 14 parts by weight |
| Polyether denatured silicone oil (L-7607, containing polyether group in side chain, Nippon Unicar Co., Ltd.) | 1 part by weight |
| 2-Butanone | 80 parts by weight |
| Toluene | 20 parts by weight |

Same as in embodiment 1, at recording heat of 6 J/cm$^2$, same recording was repeated three times. As a result, sticking and crease occurred in all three tests.

COMPARATIVE EXAMPLE 2

On the lower surface of the PET film forming the color material layer of embodiment 1 on the upper surface, the following heat resistant lubricating layer paint was applied same as in embodiment 1, and an ink sheet was prepared. The film thickness of the heat resistant lubricating layer is about 1.5 $\mu$m.

| (Heat resistant lubricating layer paint) | |
|---|---|
| Polyvinyl acetal resin (KS-5) | 14 parts by weight |
| Polyether denatured silicone oil (L-7602, containing polyether group in side chain, Nippon Unicar Co., Ltd.) | 1 part by weight |
| 2-Butanone | 80 parts by weight |
| Toluene | 20 parts by weight |

Same as in embodiment 1, at recording heat of 6 J/cm$^2$, same recording was repeated three times. As a result, sticking and crease occurred in all three tests, but at recording heat of 5.6 J/cm$^2$, it traveled smoothly on the thermal head. When this ink sheet was stored for 15 days at 50° C. and 60% RH same as in embodiment 1, and recording and traveling were tested, and the upper energy of recording energy not causing crease was 5.3 J/cm$^2$.

COMPARATIVE EXAMPLE 3

On the lower surface of the PET film forming the color material layer of embodiment 1 on the upper surface, the following heat resistant lubricating layer paint was applied same as in embodiment 1, and an ink sheet was prepared. The film thickness of the heat resistant lubricating layer is about 1.5 $\mu$m.

| (Heat resistant lubricating layer paint) | |
|---|---|
| Polyvinyl acetal resin (KS-5) | 14 parts by weight |
| Amino denatured silicone oil (KF-860, Shin-etsu Chemical Co., Ltd.) | 1 part by weight |
| 2-Butanone | 80 parts by weight |
| Toluene | 20 parts by weight |

Same as in embodiment 1, at recording heat of 6 J/cm$^2$,. same recording was repeated three times. As a result, sticking and crease occurred in all three tests, but at recording heat of 5.4 J/cm$^2$, it traveled smoothly on the thermal head. When this ink sheet was stored for 15 days at 50° C. and 60% RH same as in embodiment 1, and recording and traveling were tested, and the upper energy of recording energy not causing crease was 5.2 J/cm$^2$.

COMPARATIVE EXAMPLE 4

Image-receiving sheet: The image-receiving sheet of embodiment 14 was used.

Ink sheet: On the anchor coat layer or the PET film with heat resistant lubricating layer (prepared in embodiment 14), the following C color material layer paint and Y color material layer paint were applied same as in embodiment 14, and an ink sheet was prepared. The film thickness was about 0.9 $\mu$m in both color layers.

| (C color material layer paint) | |
|---|---|
| Acrylonitrile-styrene copolymer (AS-S) | 8 parts by weight |
| Dye (symbol P1 in Table 3) | 5.6 parts by weight |
| Polyether denatured silicone oil (L-7607) | 0.2 part by weight |
| 2-Butanone | 50 parts by weight |
| Toluene | 50 parts by weight |
| (Y color material layer paint) | |
| Acrylonitrile-styrene copolymer (AS-S) | 8 parts by weight |
| Dye (symbol Y1 in Table 4) | 4 parts by weight |
| Polyether denatured silicone oil (L-7607) | 0.2 part by weight |
| 2-Butanone | 50 parts by weight |
| Toluene | 50 parts by weight |

Same as in embodiment 14, after storing for 10 days in a thermostatic oven at 50° C. and 60% RH, the ink sheet and image-receiving sheet were joined together, and recording was evaluated same as in embodiment 14. as a result, yellow color mixing was not found in the cyan single color image (recording density 2.05), but small spots of cyan color mixing at maximum density of 0.38 were found in the yellow single color image (recording density 2.10)

COMPARATIVE EXAMPLE 5

Ink sheet: The ink sheet of embodiment 24 was used.

Image-receiving sheet: On the anchor coat layer of the white PET film of embodiment 14, the following dye image-receiving layer paint was applied by microgravure coater, and then drying in hot air at 100° C., a dye image-receiving layer (about 3 μm thick) was prepared. Thus, an image-receiving sheet was fabricated.

| (Dye image-receiving layer paint) | |
|---|---|
| Polyvinyl butyral resin (BL-3) | 10 parts by weight |
| Polyether denatured silicone oil (L-7607) | 0.5 part by weight |
| 2-Butanone | 50 parts by weight |
| Toluene | 30 parts by weight |

The ink sheet and image-receiving sheet were joined together, and the both were placed between a thermal head and a platen, and recording was conducted in the same recording condition as in embodiment 14. Next, the image-receiving sheet having this cyan recording image (recording density 2.05) was stored for 10 days in a thermostatic oven at 50° C. and 60% RH, and taken out, and evaluated same as in embodiment 24. As a result, part of the dye was migrated to the index finger, and the unrecorded portion was stained with cyan dye.

COMPARATIVE EXAMPLE 6

Ink sheet: The ink sheet of embodiment 24 was used.

Image-receiving sheet: An image-receiving sheet was prepared by forming a dye image-receiving layer (about 3 μm thick) same as in comparative example 5, by using a dye image-receiving layer paint replacing only the polyether denatured silicone oil (L-7607) in the dye image-receiving layer paint in comparative example5 with amino denatured silicone oil (KF865, Shin-etsu Chemical Co., Ltd.). Thereafter, same as in comparative example 5, the image-receiving sheet having cyan recording image (recording density 2.03) was stored, and evaluated same as in embodiment 24. As a result, part of the dye was migrated to the index finger, and the unrecorded portion was stained with cyan dye.

COMPARATIVE EXAMPLE 7

Ink sheet: The ink sheet of embodiment 24 was used.

Image-receiving sheet: On the anchor coat layer of the upper surface of the white PET film (about 100 μm thick) having isocyanate crosslinked polyester anchor coat layers (about 0.1 μm thick) on both upper and lower surfaces, the dye image-receiving layer paint of embodiment 14 was applied by microgravure coater, and then drying in hot air at 100° C., a dye image-receiving layer was formed, and the following resin layer paint was similarly applied to the anchor coat layer of the lower surface. Thus, an image-receiving sheet having a dye image-receiving layer (about 3 μm thick) on the upper surface and a resin layer (about 5 μm thick) on the lower surface was prepared.

| (Resin layer paint) | |
|---|---|
| Methacrylic resin (Acripet VH) | 10 parts by weight |
| Polyether denatured silicone oil (L-7602) | 0.5 part by weight |
| Acetone | 40 parts by weight |
| Toluene | 20 parts by weight |

Using the ink sheet and image-receiving sheet, recording same as in embodiment 35, three image-receiving sheets recording cyan image (recording density 2.02) on the dye image-receiving layer were prepared. Thereafter, same as in embodiment 35, the storage test of recording image was conducted. As a result, the resin layer at the lower surface of the image-receiving sheet was slightly stained with cyan color, and the staining density was 0.17.

Thus, the constitution of the invention provides ink sheets for thermal transfer recording including a heat resistant lubricating layer, having sufficient lubricating characteristic on the surface of heat resistant lubricating layer, excellent in running stability in recording, and showing favorable storage characteristic hardly lowered in the lubricating characteristic after storage in the condition of high temperature and high humidity, and also ink sheets and image-receiving sheets for sublimation type thermal transfer recording, excellent in thermal fusion preventing characteristic between the ink sheet and image-receiving sheet, showing favorable storage characteristic less contaminated by dye by re-transfer of dye after storage in the condition of high temperature and high humidity, reusable in paint, and hence economical.

What is claimed is:

1. An image-receiving sheet for sublimation thermal transfer recording comprising:

a base material, and a dye image-receiving layer placed on said base material, containing a resin having dye affinity, and a polysiloxane-polyoxy alkylene block copolymer, wherein said polysiloxane-polyoxy alkylene block copolymer has a unit shown in formula (A):

(A)

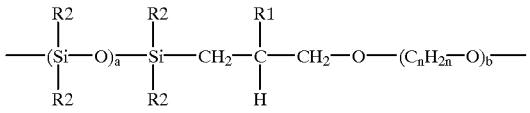

-continued

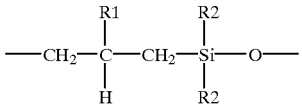

where a and b are integers of 2 or more, each R1 out of plural R1's is hydrogen atom or monovalent hydrocarbon, each R2 out of plural R2's is a monovalent hydrocarbon, and each R1 and R2 is either same or different, n is an integer of 2 to 4, and $(C_nH_{2n}—O)$ b unit is either one unit or two or more units of $(C_nH_{2n}—O)$ b units having mutually arbitrary values of n, and in the case of two or more units of $(C_nH_{2n}—O)$ b units having mutually arbitrary values of n, the value of b is either same or different.

2. An image-receiving sheet for thermal transfer recording comprising:

a base material, and a dye image-receiving layer placed on said base material, containing a resin having dye affinity, and a polysiloxane-polyoxy alkylene block copolymer, wherein said polysiloxane-polyoxy alkylene block copolymer has a unit shown in formula (C):

(C)

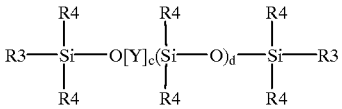

where d and c are integers of 2 or more, each R4 out of plural R4's is a monovalent hydrocarbon, and each R4 is either same or different, R3 is a residual group in which monomer containing an ethylenic unsaturated group is saturated by H, and Y is group indicated by formula (A):

(A)

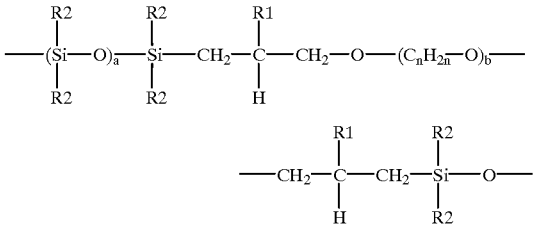

where a and b are integers of 2 or more, each R1 out of plural R1's is hydrogen atom or monovalent hydrocarbon, each R2 out of plural R2's is a monovalent hydrocarbon, and each R1 and R2 is either same or different, n is an integer of 2 to 4, and $(C_nH_{2n}—O)$ b unit is either one unit or two or more units of $(C_nH_{2n}—O)$ b units having mutually arbitrary values of n, and in the case of two or more units of $(C_nH_{2n}—O)$ b units having mutually arbitrary values of n, the value of b is either same or different.

3. An image-receiving sheet for thermal transfer recording of claim 2, wherein said monomer has an epoxy group, an amino group, a hydroxy group, or a carboxy group.

4. An image-receiving sheet for sublimation thermal transfer recording comprising:

a base material having a first surface and a second surface, a dye image-receiving layer placed on said first surface, and a resin layer placed on said second surface, containing a high molecular substance, and a polysiloxane-polyoxy alkylene block copolymer, wherein said polysiloxane-polyoxy alkylene block copolymer has a unit shown in formula (A):

(A)

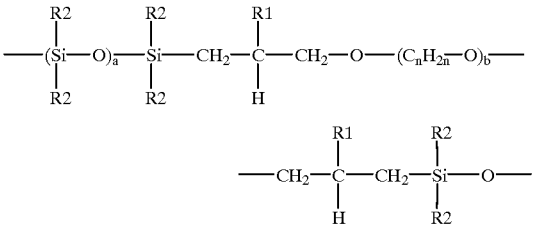

where a and b are integers of 2 or more, each R1 out of plural R1's is hydrogen atom or monovalent hydrocarbon, each R2 out of plural R2's is a monovalent hydrocarbon, and each R1 and R2 is either same or different, n is an integer of 2 to 4, and $(C_nH_{2n}—O)$ b unit is either one unit or two or more units of $(C_nH_{2n}—O)$ b units having mutually arbitrary values of n, and in the case of two or more units of $(C_nH_{2n}—O)$ b units having mutually arbitrary values of n, the value of b is either same or different.

5. An image-receiving sheet for sublimation thermal transfer recording comprising:

a base material having a first surface and a second surface, a dye image-receiving layer placed on said first surface, and a resin layer placed on said second surface, containing a high molecular substance, and a polysiloxane-polyoxy alkylene block copolymer, wherein said polysiloxane-polyoxy alkylene block copolymer has a unit shown in formula (C):

(C)

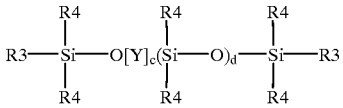

where d and c are integers of 2 or more, each R4 out of plural R4's is a monovalent hydrocarbon, and each R4 is either same or different, R3 is a residual group in which a monomer containing an ethylenic unsaturated group is saturated by H, and Y is group indicated by formula (A):

(A)

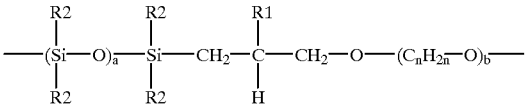

-continued

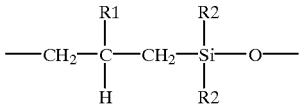

where a and b are integers of 2 or more, each R1 out of plural R1's is hydrogen atom or monovalent hydrocarbon, each R2 out of plural R2's is a monovalent hydrocarbon, and each R1 and R2 is either same or different, n is an integer of 2 to 4, and $(C_nH_{2n}—O)$ b unit is either one unit or two or more units of $(C_nH_{2n}—O)$ b units having mutually arbitrary values of n, and in the case of two or more units of $(C_nH_{2n}—O)$ b units having mutually arbitrary values of n, the value of b is either same or different.

6. An image-receiving sheet for thermal transfer recording of claim 5, wherein said monomer has an epoxy group, an amino group, a hydroxy group, or a carboxy group.

7. A medium for sublimation thermal transfer recording comprising:

a base material sheet having a first surface and a second surface, and a color function layer placed on said first surface, wherein said color function layer comprises (a) a medium element for sublimation thermal transfer recording, and (b) a polysiloxane-polyoxy alkylene block copolymer; wherein:

said medium element is either a resin having dye affinity or a color material; and said polysiloxane-polyoxy alkylene block copolymer has a constituent unit of a polysiloxane group shown in formula (A1) and a polyoxy alkylene group shown in formula (A2) in its main chain:

(A1)

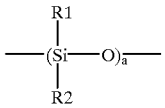

(A2)

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually values of n, the value of b is either the same or different.

8. A medium for diffusion thermal transfer recording of claim 7, wherein said medium element is a color material, and said color material executes at least one of sublimation and diffusion by heating.

9. A medium for sublimation thermal transfer recording of claim 7, wherein said medium element comprises at least one color material selected from the group consisting of cyan color materials, magenta color materials, and yellow color materials.

10. A medium for sublimation thermal transfer recording of claim 7, wherein said color function layer is a color material and further comprises (c) a high molecular weight substance.

11. A medium for sublimation thermal transfer recording of claim 10, wherein said polysiloxane-polyoxy alkylene block copolymer is contained in a range of about 0.1 part by weight to about 30 parts by weight in 100 parts by weight of said high molecular substance.

12. A medium for sublimation thermal transfer recording of claim 7, wherein said polysiloxane-polyoxy alkylene block copolymer has a constituent unit shown in formula (B1) at its end in chemical structure:

(B1)

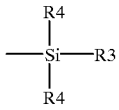

where each R4 out of plural R4's is a monovalent hydrocarbon, and each R4 is either the same of different, R3 is a residual group in which a monomer containing an ethylenic unsaturated group is saturated by H.

13. A medium for thermal transfer recording of claim 12, wherein said monomer has an epoxy group, an amino group, a hydroxy group, or a carboxy group.

14. A medium for sublimation thermal transfer recording of claim 7, wherein said medium element is a resin having dye affinity.

15. A medium for sublimation thermal transfer recording of claim 14, further comprising a resin layer on said second surface.

16. A medium for sublimation thermal transfer recording of claim 15, wherein said resin layer comprises a high molecular weight substance and a further polysiloxane-polyoxy alkylene block copolymer.

17. A medium for sublimation thermal transfer recording of claim 7, wherein said polysiloxane-polyoxy alkylene block copolymer has a constituent unit shown in formula (B2) at its end in chemical structure:

(B2)

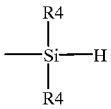

where each R4 out of plural R4's is a monovalent hydrocarbon, and each R4 is either the same of different.

18. A medium for sublimation thermal transfer recording of claim 7, wherein said polysiloxane-polyoxy alkylene block copolymer further has a constituent unit shown in formula (D) at the end of its main chain in chemical structure:

(D)

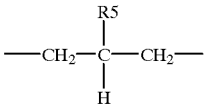

where R5 is hydrogen or a monovalent hydrocarbon.

19. A medium for sublimation thermal transfer recording of claim 7, further comprising a heat resistant lubricating layer placed on said second surface.

20. A medium for sublimation thermal transfer recording of claim 19, wherein said heat resistant lubricating layer contains a high molecular weight substance and a further polysiloxane-polyoxy alkylene block copolymer.

21. A medium for sublimation thermal transfer recording comprising:

a base sheet having a first surface and a second surface, a color function layer placed on said first surface, and a lubricating layer placed on said second surface;

wherein said color function layer contains (a) a medium element for sublimation thermal transfer recording, and (b) a block copolymer of polysiloxane and polyoxy alkylene; said medium element is either a resin having dye affinity or a color material; and said lubricating layer comprises a polysiloxane-polyoxy alkylene block copolymer and said polysiloxane-polyoxy alkylene block copolymer has a constituent unit of a polysiloxane group shown in formula (A1) and a polyoxy alkylene group shown in formula (A2) in its main chain:

(A1)

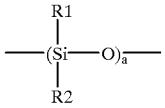

(A2)

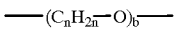

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually arbitrary values of n, the value of b is either the same or different.

22. A medium for sublimation thermal transfer recording of claim 21, wherein said lubricating layer comprises said polysiloxane-polyoxy alkylene block copolymer and a high molecular weight substance.

23. A medium for sublimation thermal transfer recording of claim 22, wherein said polysiloxane-polyoxy alkylene block copolymer is contained in a range of about 0.1 part per weight to about 30 parts by weight in a total of 100 parts by weight of said high molecular weight substance.

24. A medium for sublimation thermal transfer recording of claim 22, wherein said lubricating layer forms a crosslinked structure in its chemical structure.

25. A medium for sublimation thermal transfer recording of claim 21, wherein said medium element is a color material having at least one function of sublimation and diffusion.

26. A medium for sublimation thermal transfer recording of claim 21, wherein said lubricating layer contains a silicone graft resin.

27. A medium for sublimation thermal transfer recording of claim 21, wherein said polysiloxane-polyoxy alkylene block copolymer further has a constituent unit shown in formula (d) in its main chain chemical structure:

(D)

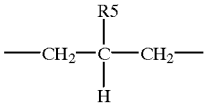

where R5 is hydrogen or a monovalent hydrocarbon.

28. A medium for sublimation thermal transfer recording of claim 21, wherein said lubricating layer comprises a crosslinked structure which is formed by a crosslinking reaction between a material having active hydrogens and a crosslinking agent.

29. An image receiving sheet for sublimation thermal transfer recording, the sheet comprising:

a base material having a first surface and a second surface;

a dye image-receiving layer on said first surface, said dye image-receiving layer comprising a resin having dye affinity; and optionally, a resin layer on said second surface, said resin layer comprising a high molecular weight substance; wherein:

at least one of said dye image-receiving layer and said resin layer comprises a polysiloxane-polyoxy alkylene block copolymer; and said polysiloxane-polyoxy alkylene block copolymer has a unit shown in formula (A):

(A)

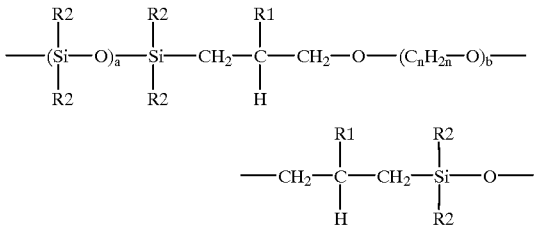

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually values of n, the value of b is either the same or different.

30. A ink sheet for thermal transfer recording comprising:

a base material having a first surface and a second surface, a color material placed on said first surface, a heat resistant lubricating layer placed on said second surface, said lubricating layer comprising a polysiloxane-polyoxy alkylene block copolymer shown in formula (A):

(A)

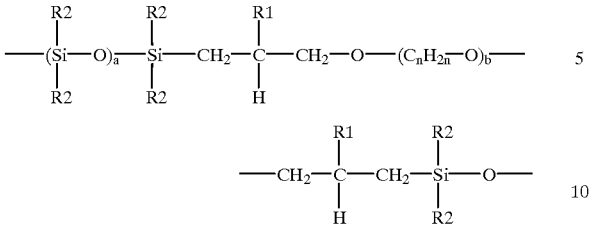

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually values of n, the value of b is either the same or different.

31. An ink sheet for thermal transfer recording claim 30, wherein said heat resistant lubricating layer comprises a silicone graft resin.

32. An ink sheet for thermal transfer recording claim 30, wherein said heat resistant lubricating layer comprises fine particles.

33. An ink sheet for thermal transfer recording claim 30, wherein said heat resistant lubricating layer comprises a silicone graft resin and fine particles.

34. An ink sheet for thermal transfer recording of claim 30, wherein said heat resistant lubricating layer is a crosslinked structure which is formed by a crosslinking reaction between a material having active hydrogens and a crosslinking agent.

35. An ink sheet for thermal transfer recording of claim 30, wherein said heat resistant lubricating layer comprises at least one resin selected from the group consisting of acrylpolyols, polyvinyl acetals, and polyester polyols.

36. An ink sheet for thermal transfer recording comprising:

a base material having a first surface and a second surface, a color material placed on said first surface, a heat resistant lubricating layer placed on said second surface, said lubricating layer comprising a polysiloxane-polyoxy alkylene block copolymer shown in formula (C):

(C)

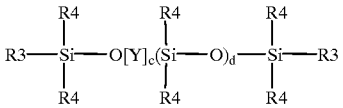

where d and c are integers of 2 or more, each R4 out of plural R4's is a monovalent hydrocarbon, and each R4 is either the same or different, R3 is a monomer containing an ethylenic unsaturated group saturated by H, and Y is a group indicated by formula (A):

(A)

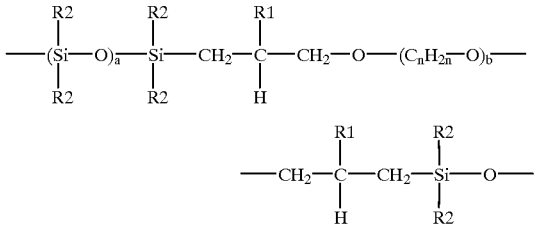

where a and b are integers of 2 or more, each R1 out of plural R1's is a hydrogen or a monovalent hydrocarbon, each R2 out of plural R2's is a monovalent hydrocarbon, and each R1 and R2 is either the same or different, n is an integer of 2 to 4, and $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually arbitrary values of n, the value of b is either the same or different.

37. An ink sheet for thermal transfer recording claim 36, wherein said heat resistant lubricating layer comprises a silicone graft resin.

38. An ink sheet for thermal transfer recording claim 36, wherein said heat resistant lubricating layer comprises fine particles.

39. An ink sheet for thermal transfer recording claim 36, wherein said heat resistant lubricating layer comprises a silicone graft resin and fine particles.

40. An ink sheet for thermal transfer recording of claim 36, wherein said heat resistant lubricating layer is a crosslinked structure which is formed by a crosslinking reaction between a material having active hydrogens and a crosslinking agent.

41. An ink sheet for thermal transfer recording of claim 36, wherein said heat resistant lubricating layer comprises at least one resin selected from the group consisting of acrylpolyols, polyvinyl acetals, and polyester polyols.

42. An ink sheet for transfer recording of claim 36, wherein said monomer has an epoxy group, an amino group, a hydroxy group, or a carboxy group.

43. An ink sheet for thermal transfer recording comprising:

a base material, and a color material layer placed on said base material, said layer comprising a dye, a binder, and a polysiloxane-polyoxy alkylene block copolymer, wherein said polysiloxane-polyoxy alkylene block copolymer has a unit shown in formula (A):

(A)

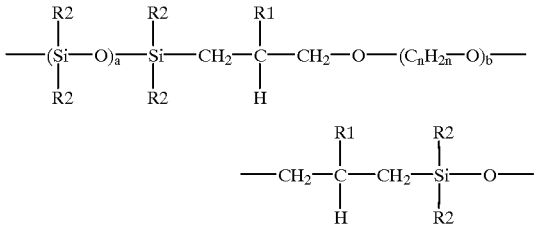

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually values of n, the value of b is either the same or different.

44. An ink sheet for sublimation thermal transfer recording of claim 43, wherein said dye is an indoaniline dye.

45. An ink sheet for sublimation thermal transfer recording of claim 43, wherein said dye has at least one of sublimation function and diffusion function.

46. An ink sheet for thermal transfer recording comprising:

a base material, and a color material layer placed on said base material, said layer comprising a dye, a binder, and a polysiloxane-polyoxy alkylene block copolymer, wherein said polysiloxane-polyoxy alkylene block copolymer shown in formula (C):

(C)

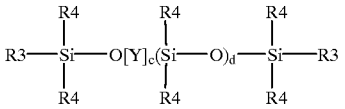

where d and c are integers of 2 or more, each R4 out of plural R4's is a monovalent hydrocarbon, and each R4 is either the same or different, R3 is a monomer containing an ethylenic unsaturated group saturated by H, and Y is a group indicated by formula (A):

(A)

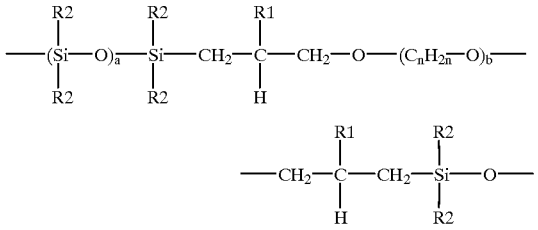

where a and b are integers of 2 or more, each R1 out of plural R1's is hydrogen or a monovalent hydrocarbon, each R2 out of plural R2's is a monovalent hydrocarbon, and each R1 and R2 is either the same or different, n is an integer of 2 to 4, and the $(C_nH_{2n}—O)_b$ unit is either one unit or two or more units of $(C_nH_{2n}—O)_b$ units having mutually arbitrary values of n, and in the case of two or more units of $(C_nH_{2n}—O)_b$ units having mutually values of n, the value of b is either the same or different.

47. An ink sheet for sublimation thermal transfer recording of claim 46, wherein said dye is an indoaniline dye.

48. An ink sheet for sublimation thermal transfer recording of claim 46, wherein said dye has at least one of sublimation function and diffusion function.

49. An ink sheet for transfer recording of claim 46, wherein said monomer has an epoxy group, an amino group, a hydroxy group, or a carboxy group.

* * * * *